US010661135B2

(12) United States Patent
Eades et al.

(10) Patent No.: US 10,661,135 B2
(45) Date of Patent: May 26, 2020

(54) SUPPORT FOR GOLF BAG TOWEL

(71) Applicant: KARSTEN MANUFACTURING CORPORATION, Phoenix, AZ (US)

(72) Inventors: Olly Eades, Loughborough (GB); Brian J. McGuire, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 85 days.

(21) Appl. No.: 15/584,691

(22) Filed: May 2, 2017

(65) Prior Publication Data

US 2017/0232314 A1 Aug. 17, 2017

Related U.S. Application Data

(63) Continuation of application No. 14/326,319, filed on Jul. 8, 2014, now abandoned.

(60) Provisional application No. 61/878,386, filed on Sep. 16, 2013.

(51) Int. Cl.
*A63B 55/00* (2015.01)

(52) U.S. Cl.
CPC ..... *A63B 55/408* (2015.10); *A63B 55/00* (2013.01); *Y10T 29/49826* (2015.01)

(58) Field of Classification Search
CPC .. A63B 55/408; A63B 55/00; Y10T 29/49826
See application file for complete search history.

(56) References Cited

U.S. PATENT DOCUMENTS

| | | | | |
|---|---|---|---|---|
| 1,739,702 | A | 12/1929 | Wing | |
| 2,075,279 | A | 3/1937 | Good | |
| 2,458,924 | A | 1/1946 | Baker | |
| 2,551,009 | A | 5/1951 | Kaltenbach | |
| 3,025,074 | A | 3/1962 | Owen | |
| 3,585,693 | A | 6/1971 | Barnhardt | |
| 4,087,068 | A | 5/1978 | Gardner | |
| 4,796,789 | A | 1/1989 | Willcocks | |
| 4,898,352 | A | 2/1990 | Hoffman | |
| 5,099,897 | A | 3/1992 | Curtin | |
| 5,102,529 | A | 4/1992 | Hickin | |
| 5,407,723 | A | 4/1995 | Curtin | |
| 5,431,364 | A * | 7/1995 | Etter | A45B 11/00 135/16 |
| 5,722,125 | A | 3/1998 | Vasilopoulos | |
| 5,899,328 | A | 5/1999 | Dulyea, Sr. | |
| 6,010,109 | A | 1/2000 | Green | |
| 6,182,983 | B1 | 2/2001 | Kim | |
| 6,273,279 | B1 | 8/2001 | Wolf | |
| 6,817,469 | B2 | 11/2004 | Chang | |
| 7,926,149 | B2 | 4/2011 | Weston | |
| 8,820,336 | B1 * | 9/2014 | Schneberger | A45B 11/00 135/16 |
| 2004/0232017 | A1 | 11/2004 | Felton | |
| 2007/0215500 | A1 | 9/2007 | Jung | |

(Continued)

*Primary Examiner* — Tri M Mai

(57) ABSTRACT

A golf bag including a body defining a housing adapted to receive one or more golf clubs, and extending between a bottom portion and a top portion. The golf bag further includes an attachment mechanism coupled to the body, and configured to secure a first portion of a towel. An auxiliary attachment mechanism is coupled to the body. The auxiliary attachment mechanism is configured to support a second portion of a towel.

4 Claims, 16 Drawing Sheets

(56) References Cited

U.S. PATENT DOCUMENTS

| | | | |
|---|---|---|---|
| 2008/0256734 | A1 | 10/2008 | Bratcher et al. |
| 2011/0290683 | A1 | 12/2011 | High |

* cited by examiner

SUPPORT FOR GOLF BAG TOWEL

CROSS-REFERENCE TO RELATED APPLICATIONS

This is a continuation of U.S. patent application Ser. No. 14/326,319, filed on Jul. 8, 2014, which claims priority to U.S. Patent Application No. 61/878,386, filed on Sep. 16, 2013, the entire contents of which are fully incorporated herein by reference.

FIELD

The present disclosure relates to an accessory to support a towel attached to bags, and in particular, for golf bags.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are generally larger and heavier golf bags designed to be carried by a pull cart or transported by a golf cart whereas the second class of golf club bags are generally smaller and lighter golf bags designed to be carried by the individual during play. In particular, the second class of golf bags are usually referred to as "carry bags" which are carried by the individual using a carrying strap arrangement that may be used to lift and carry the golf bag. Many carrying bags have a carrying strap arrangement consisting of either one or two carrying straps for lifting and carrying the golf bag on the individual's shoulders.

During early morning rounds or on rainy days when the grass is wet, golf clubs typically become wet and dirty each time they are used. It is disadvantageous for the club head to be wet or have dirt and other particles on the club face because such water and debris affect the striking surface of the club head. Therefore, golfers usually bring at least one towel for drying and cleaning the golf club after each use.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

Before any embodiments of the apparatus, methods, and articles of manufacture are explained in detail, it is to be understood that this disclosure is not limited in its application to the details of construction and the arrangement of components set forth in the following description or illustrated in the following drawings. The apparatus, methods, and articles of manufacture described herein may include other embodiments and may be practiced or carried out in various ways.

Figure 1:
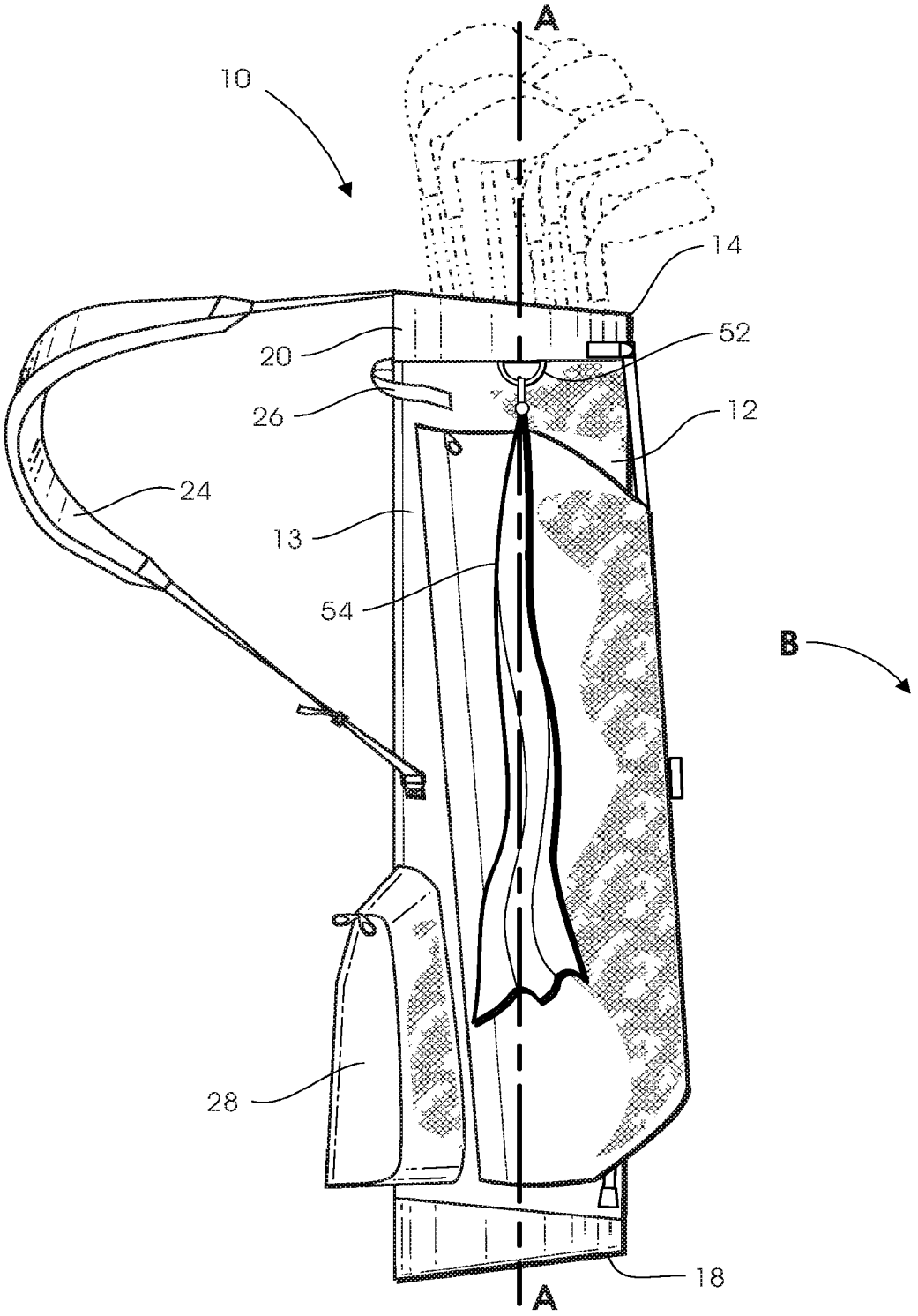
FIG. 1 is a side view of a golf bag including a towel.

With reference to FIG. 1, a golf bag 10 comprises a generally tubular body 12 that may include a housing 13 extending between an open, top portion 14 and a closed, bottom portion 18. The top portion 14 may be located on a top end of the body 12, and the bottom portion 18 may be located opposite of the top portion 14 on the bottom end of the body 12. A longitudinal axis A is defined between the top portion 14 and the bottom portion 18. The housing 13 may be formed of nylon or other lightweight fabric and is adapted to receive one or more golf clubs (shown in broken lines). A ring-shaped member such as a throat 20 is stitched or otherwise mounted to the top portion 14 of the body 12. The throat 20 includes a plurality of dividers 22 that segregate golf clubs with the golf clubs being inserted into and removed from the bag 10 through the throat 20. The bottom portion 18 may be rigid and similarly mounted to the bottom end of the body 12. Both the bottom portion 18 and the throat 20 may be molded or otherwise formed of a suitable synthetic resin in a manner well known in the art. The golf bag 10 may also include various other features normally associated with golf bags such as a shoulder strap 24, a handle 26 and at least one accessory pocket 28. The golf bag 10 also includes an attachment mechanism 52 coupled to the body 12 and positioned near the throat 20. A generally rigid spine (not shown) interconnects the throat 20 and the bottom portion 18 to keep the throat 20 and the bottom portion 18 in a spaced-apart relationship. The spine may be made of wood, fiberglass or other suitable rigid lightweight material. Lower end of the spine may be attached by a hinge to the bottom portion 18 by means of a length of fabric or other flexible material forming a fabric hinge which permits the bottom portion 18 to pivot relative to spine. As can be determined from the foregoing, the side of the body 12 diametrically opposite the spine is partially collapsible because the spine extends along only one side of the golf bag 10. Therefore, when placed upright resting on the bottom portion 18, the golf bag 10 may collapse toward this collapsible side as indicated by arrow "B" as shown in FIG. 1.

The golf bag 10 further includes an automatically extensible stand with a U-shaped actuator rod (not shown), the lower end of which is attached to a bearing (not shown) formed in the bottom portion 18. The actuator rod has two upward extending arms 38, 40. The upper ends of arms 38 and 40 are pivotally attached collars 42, 44 formed on legs 46, 48, respectively. The legs 46, 48 are themselves pivotally attached to at least one hinge or bearing 50 formed on the throat 18.

Figure 2:
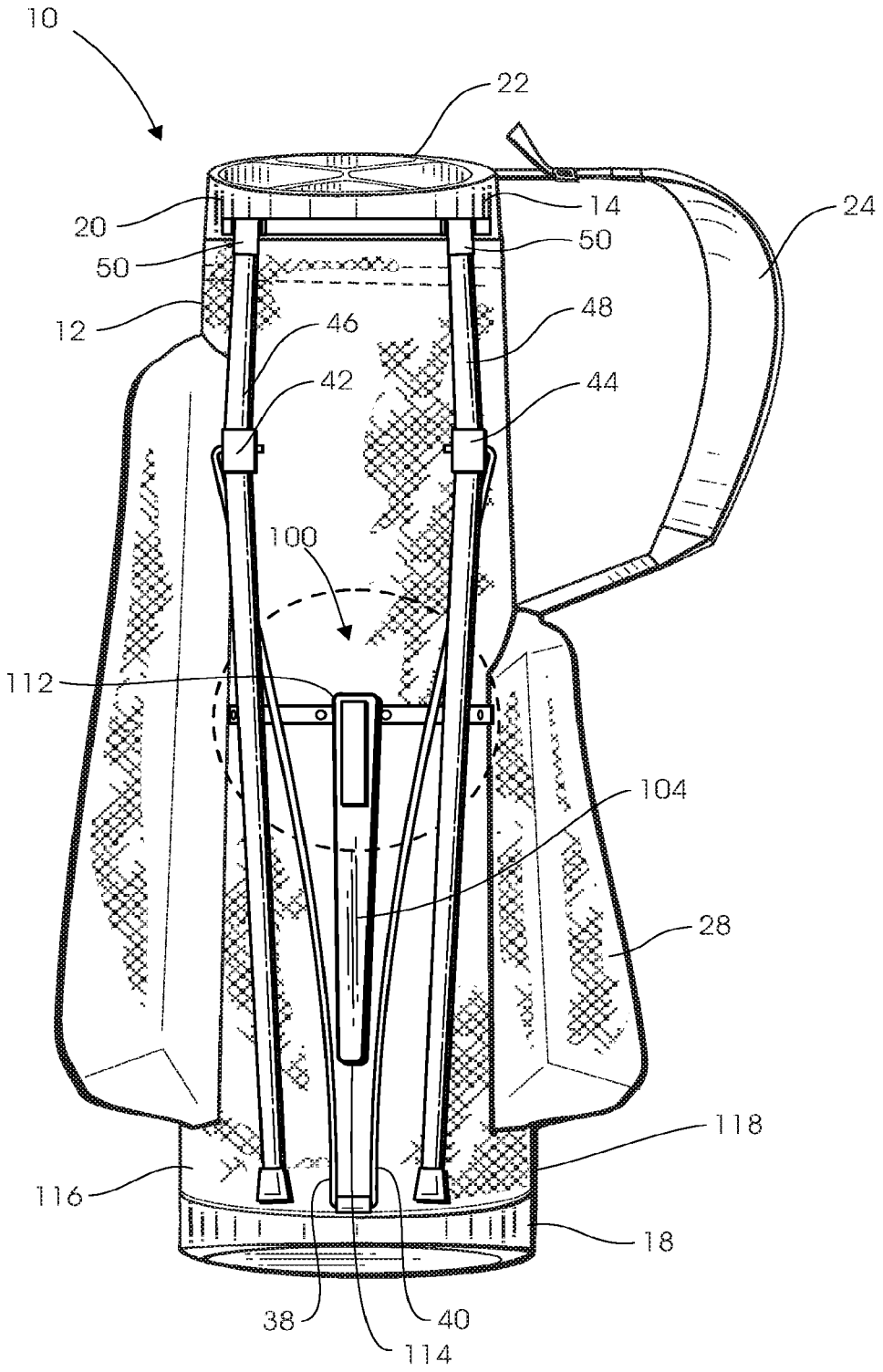
FIG. 2 is a front view of the golf bag of FIG. 1 and including an accessory according to one embodiment of the apparatus, methods, and articles of manufacture described herein, the accessory including a first member and a joint, the first member disposed in a first position relative to a body of the bag.
Figure 3:
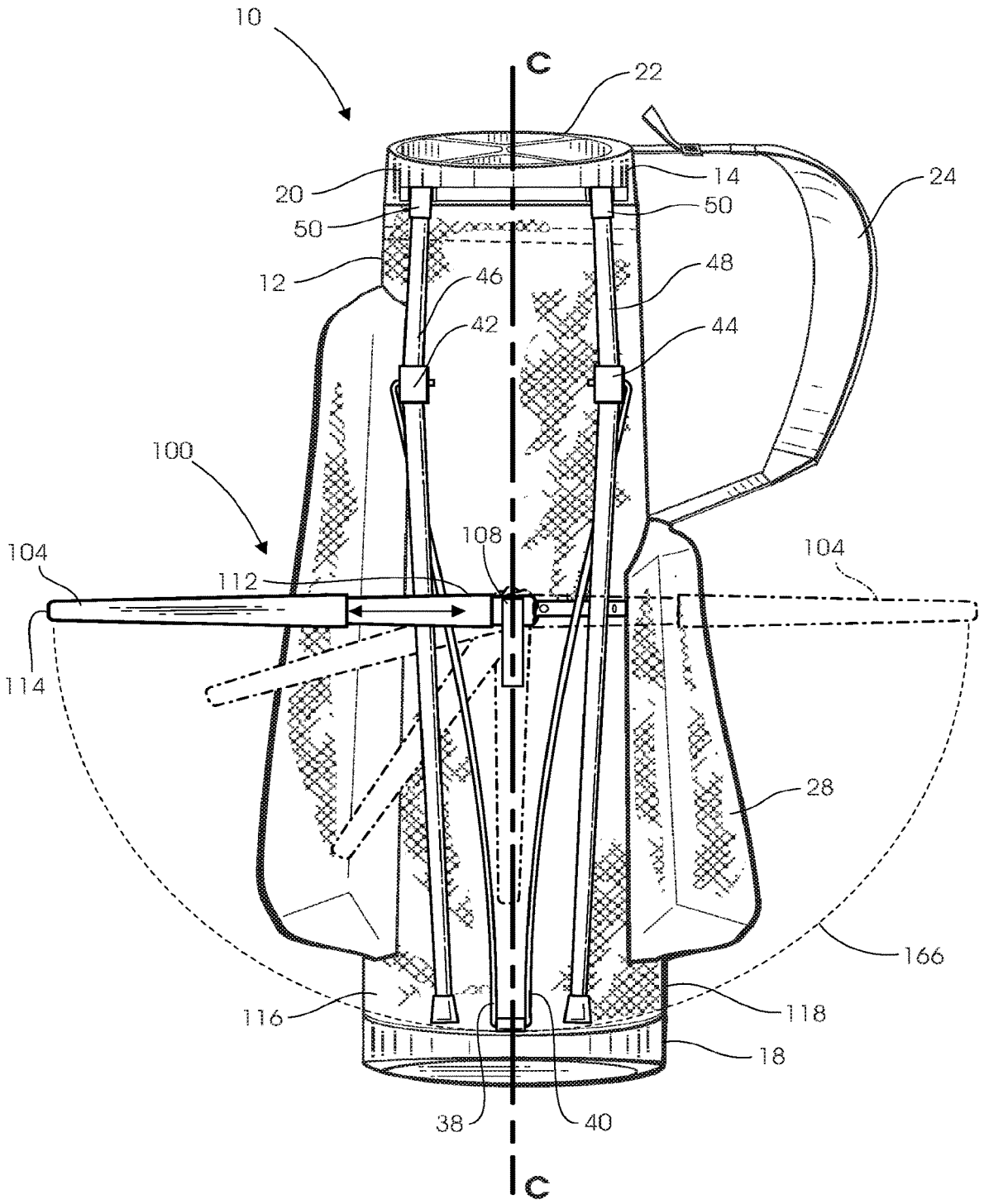
FIG. 3 is a front view of the golf bag of FIGS. 1 and 2, but illustrating the first member disposed in a second position relative to the body of the bag.
Figure 4:
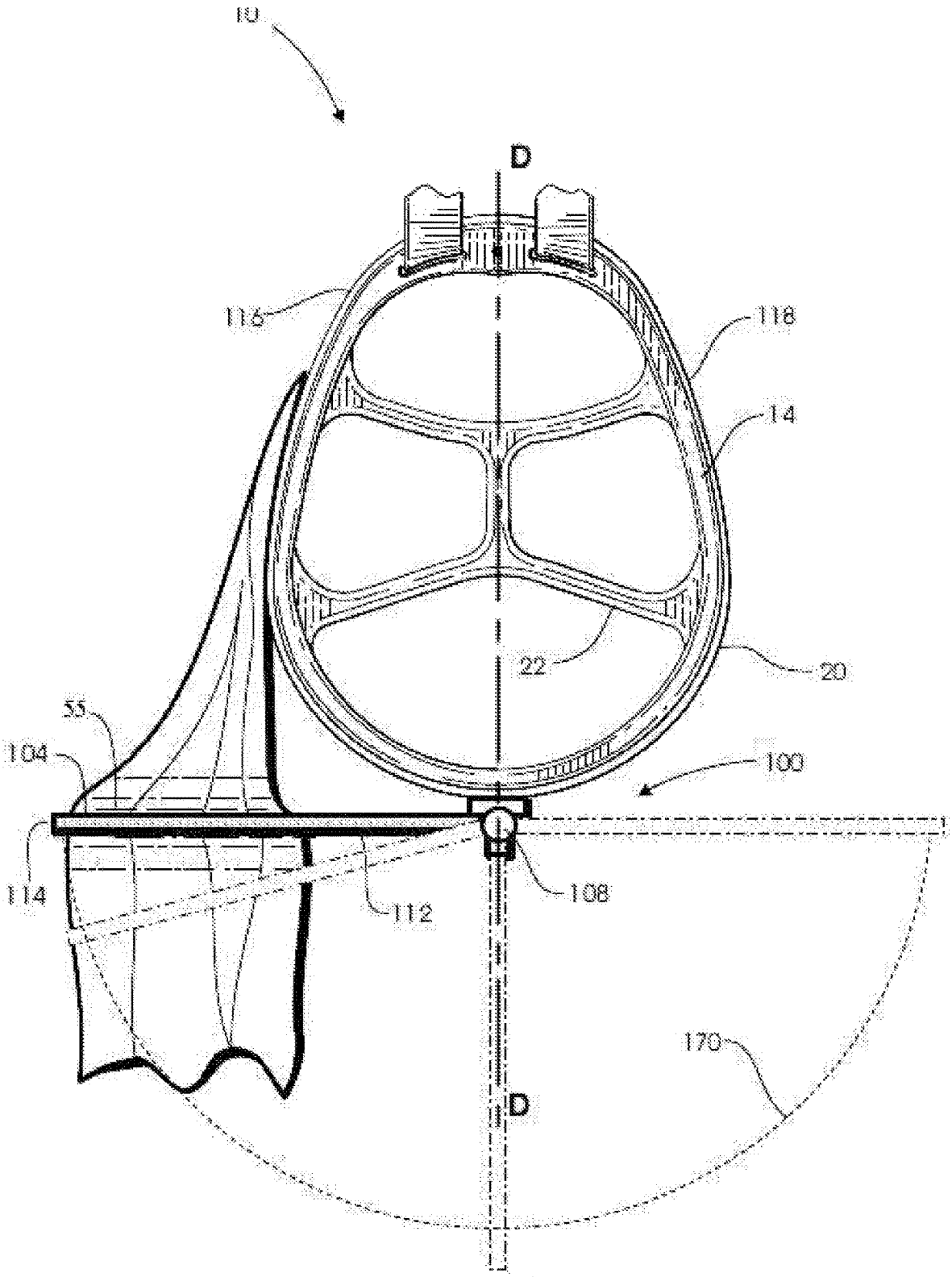
FIG. 4 is a top view of the golf bag of FIGS. 1 and 3, illustrating the accessory in the second position.

With respect to FIGS. 2-4, the golf bag 10 further includes a removable accessory 100 including a first elongate member 104 and a joint 108. The joint 108 is coupled between the first member 104 and the body 12. The first member 104 is movable between a first or stowed position (FIG. 2) in which the first member 104 extends substantially parallel to the longitudinal axis A of the bag 10, and a second or support position (FIGS. 3 and 4) in which the first member 104 extends at an angle relative to the longitudinal axis A of the body 12. The joint 108 defines a point about which the first member 104 pivots between the first position and the second position. A first end 112 of the first member 104 is coupled to the body 12 by the joint 108. A second end 114 of the first member 104 is movable along at least one 180 degree arc upon rotation of the first end 112 of the first member 104 about the joint 108. Therefore, the first member 104 is pivotable in a first direction to project from a first side 116 of the body 12 and pivotable in a second direction to project from a second, opposite side 118 of the body 12. The first member 104 is configured to support a second portion 55 of the towel 54 when in the second position such that the towel 54 extends between the attachment mechanism 52 and the first member 104. When in the second position, the accessory 100 ensures that the towel 54 is spaced apart from the bag 10.

Traditionally, the golf bag towel 54 hangs down and is only supported at one support point resulting in extraneous slack. To decrease the amount of water dripping from the towel onto the golfer if carrying the golf bag or on the bag itself if the golf bag is on a golf cart and/or to minimize slack if the towel is partially dragging on the ground when the towel is attached to a golf bag on a pull cart, the golfer either tucks the towel into a pocket on the bag or slings the towel over the clubs. The apparatus, methods, and articles of manufacture described herein may minimize the slack of the golf towel so the towel does not swing around while the golfer is walking, using a pull cart, or riding in a golf cart. In contrast, the bag 10 includes a two-point contact support system for the towel 54 because the attachment mechanism 52 is a first contact point and the first member 104 is a second contact point.

The distance of the first contact point at the attachment mechanism 52 and the second contact point of the first member 104 is a distance from each other less than the length of a golf towel 54 to ensure that the golf towel 54 can be support at both support points. Having the two support points less than the distance of the golf towel 54 can minimize slack in the towel so the golf towel 54 does not swing around while the golfer is either walking or riding on a golf cart. Decreased swinging in combination with a greater distance of the towel 54 from the golfer will minimize water dripping onto the golfer. In addition, the golfer no longer has to take the extra step of tucking the towel 54 into an accessory pocket 28 or slinging it over the clubs. This saves the golfer time in accessing and putting the towel 54 away each time. It further increases the surface area of the towel 54 in contact with the air resulting in a more consistent and quicker drying of the towel 54. Also, the first member 104 prevents the towel 54 from getting entangled in the golfer's legs and prevents the towel 54 from dragging and getting dirtied on the ground. The first member 104 may be a rigid foldable arm, a bungee cord type polymer/rubber material, or some other material providing support point for the golf towel. In the embodiments illustrated and described herein, a length of the first member 104 is adjustable (i.e., by a telescoping mechanism, for example).

Figure 5:
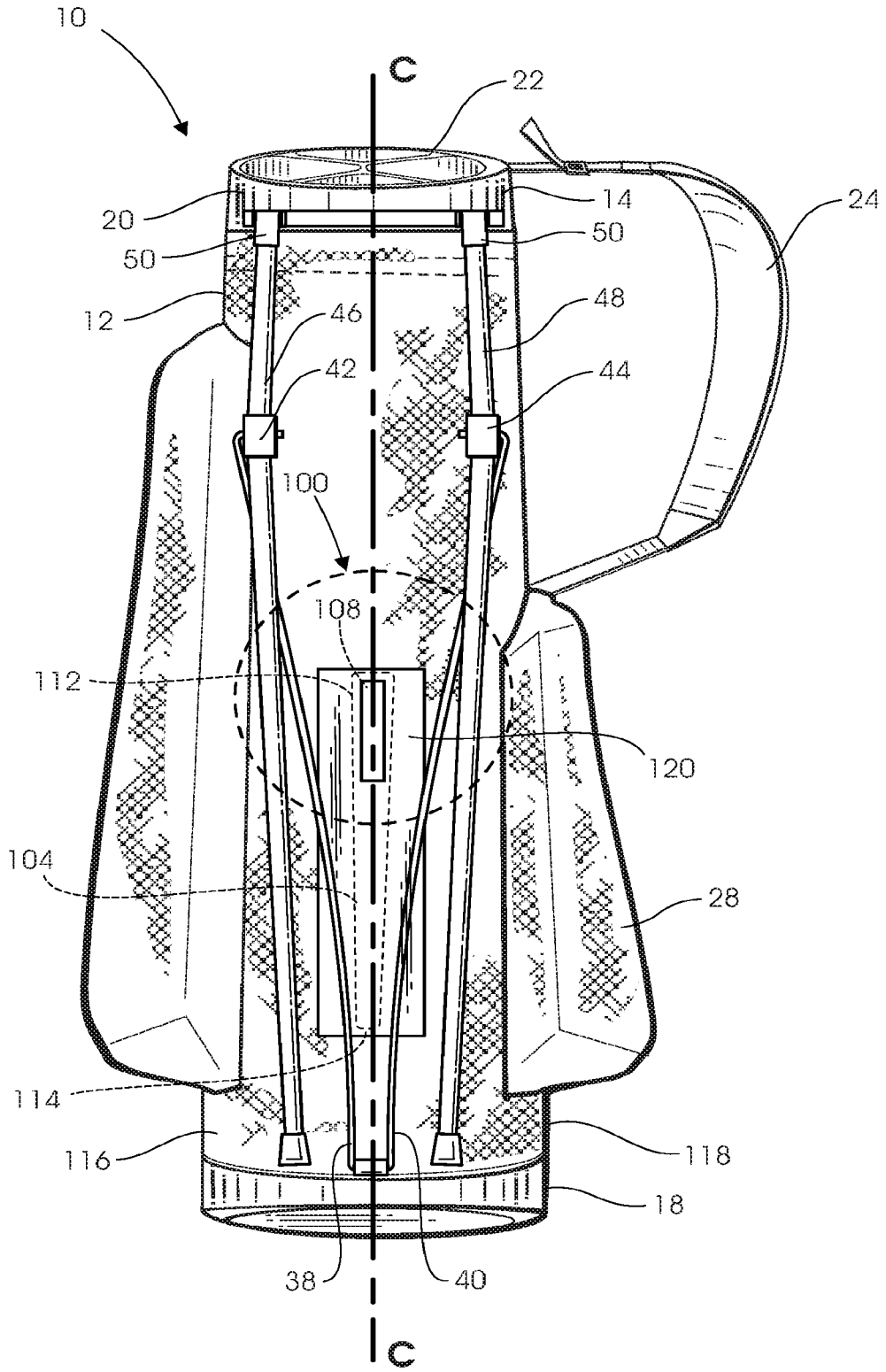
FIG. 5 is a front view of the golf bag of FIG. 1, but illustrating an accessory according to another embodiment of the apparatus, methods, and articles of manufacture described herein, the accessory including a first member, second member, and a joint, the first member disposed in a first position relative to the second member and a body of the bag.
Figure 6:
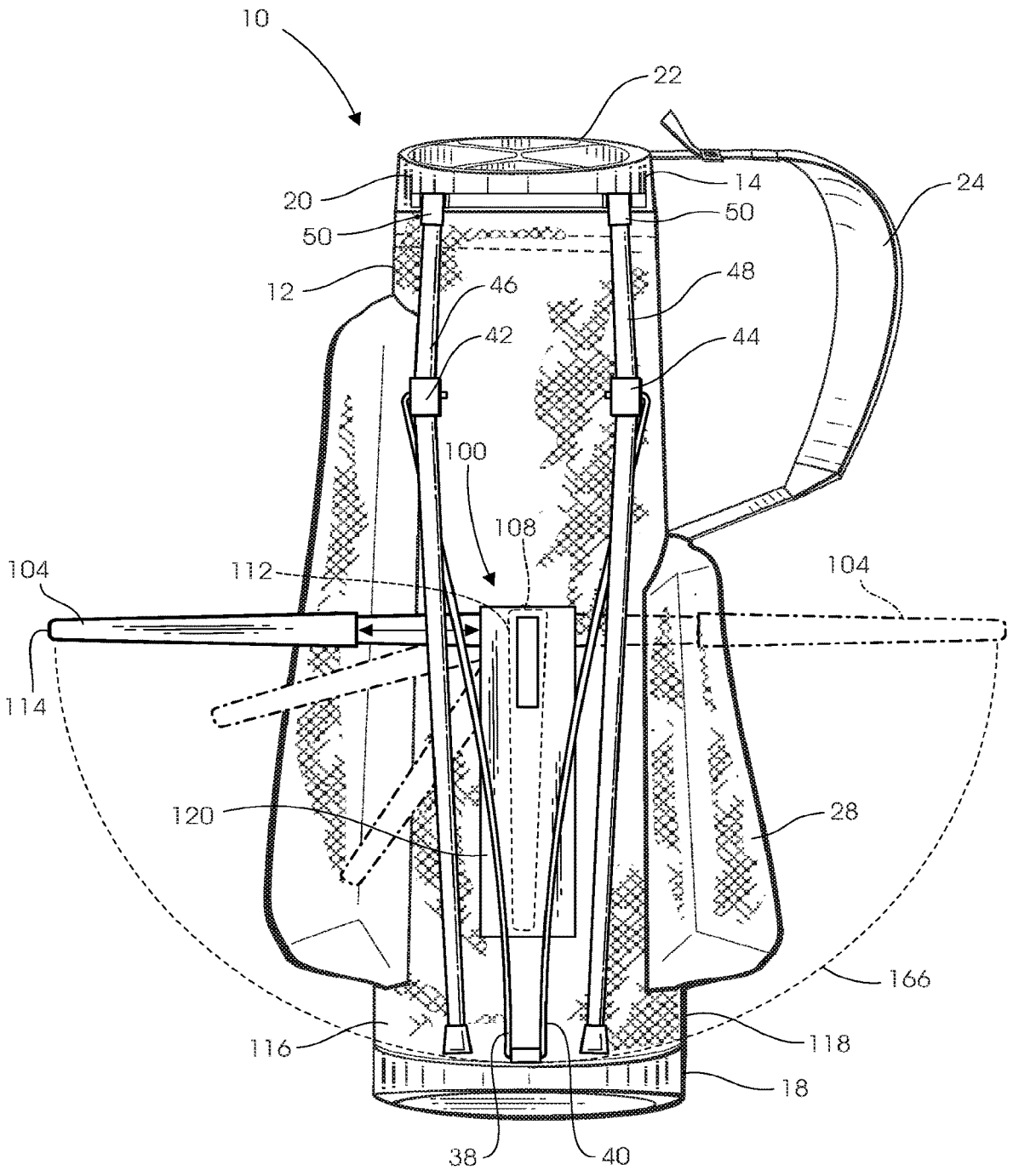
FIG. 6 is a front view of the golf bag of FIGS. 1 and 5, but illustrating the first member disposed in a second position relative to the second member and the body of the bag.
Figure 7:
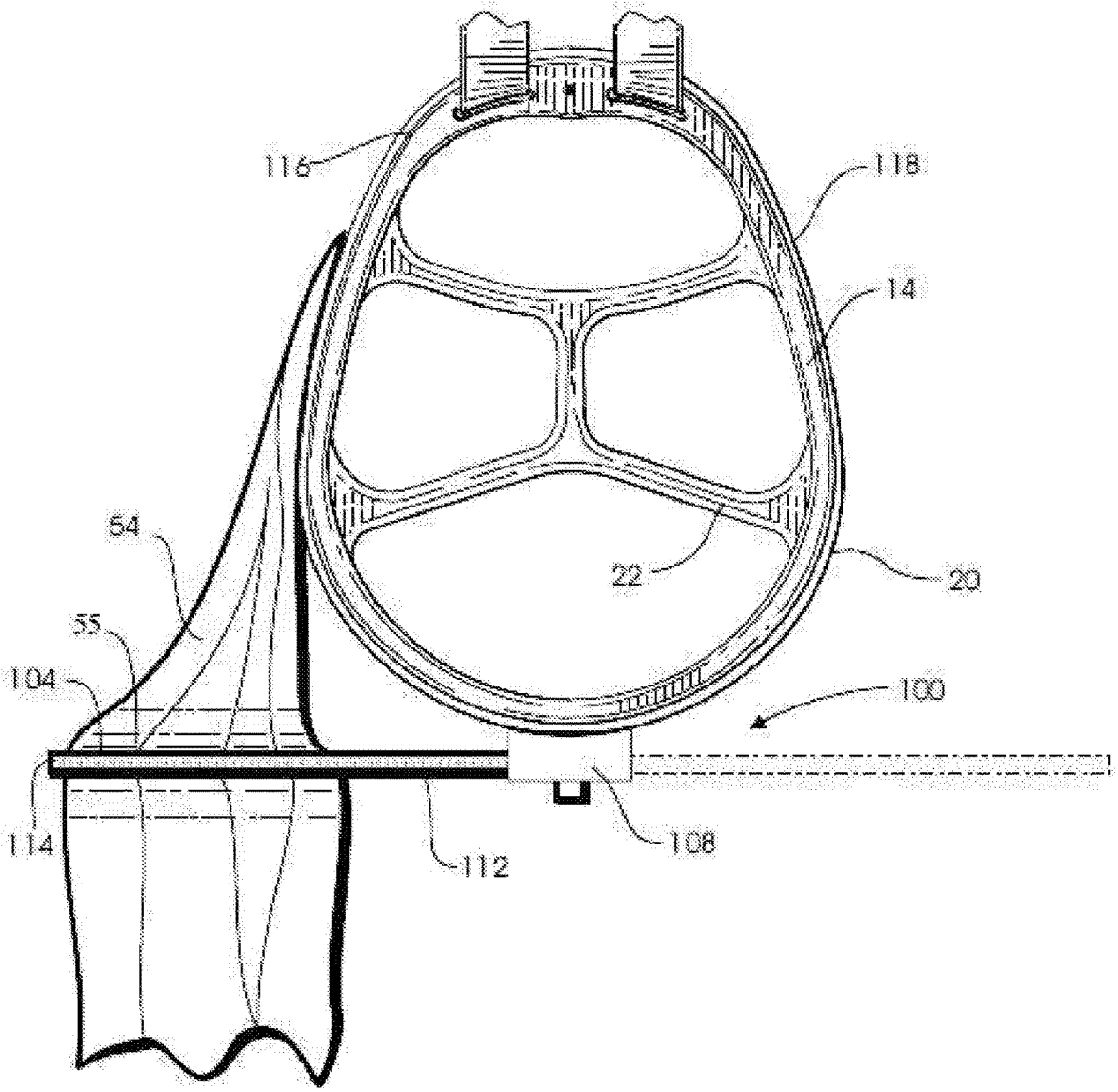
FIG. 7 is a top view of the golf bag of FIGS. 1 and 6, but illustrating the first member disposed in the second position relative to the body of the bag.

In an additional or alternative embodiment (FIGS. 5-7), the first member 104 is housed within a second, stationary member 120 when in the first position as opposed to the embodiment illustrated in FIGS. 2 and 3, which does not include a stationary member. The second member 120 may be attached (i.e., by rivets or any other suitable fastener) to the body 12 of the bag 10. The second member 120 extends parallel to the longitudinal axis A of the bag 10. The second member 120 may be a bracket that allows the first member 104 to pivot to project from opposite sides of the bag 10. Alternatively, the second member 120 may only allow the first member 104 to project from one side of the bag 10. The second member 120 secures the first member 104 in parallel with the body 12 of the bag 10 when the first member 104 is in the first position while still allowing the first member 104 to pivot relative to the bag 10 to achieve the second position.

Figure 8:
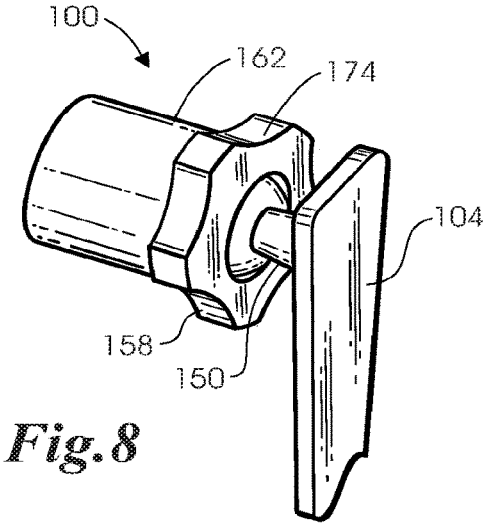
FIG. 8 is a perspective view of the joint of FIG. 2, illustrating a first joint configuration, the joint coupled between the first member and the body of the bag.
Figure 9:
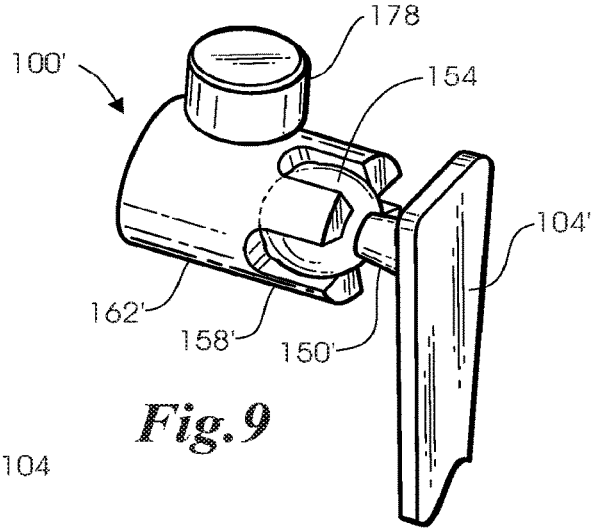
FIG. 9 is a perspective view of the joint of FIG. 2, illustrating a second joint configuration, the joint coupled between the first member and the body of the bag.
Figure 11:
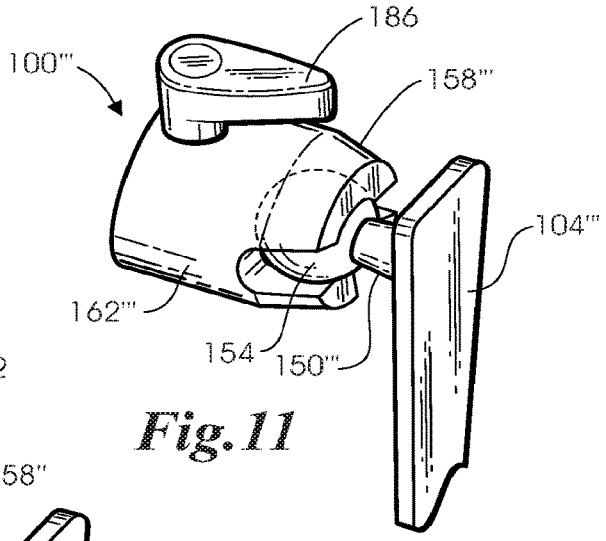
FIG. 11 is a perspective view of the joint of FIG. 2, illustrating a fourth joint configuration, the joint coupled between the first member and the body of the bag.
Figure 10:
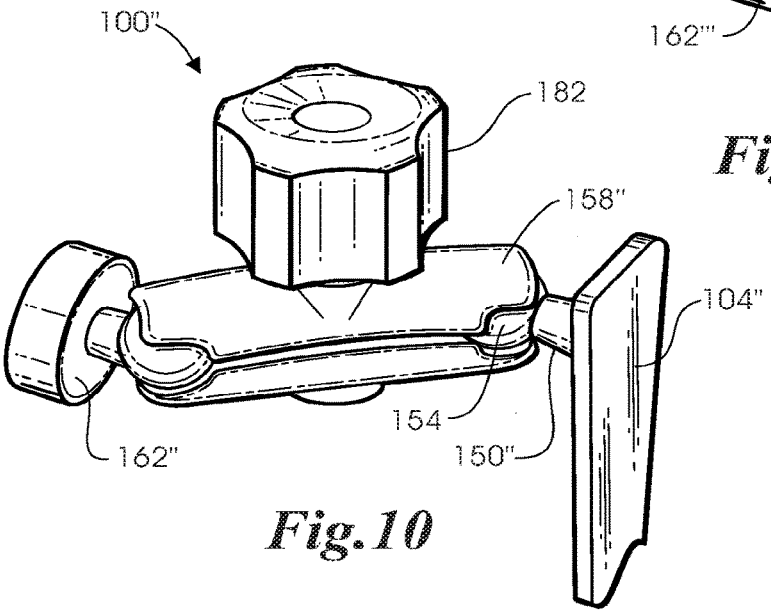
FIG. 10 is a perspective view of the joint of FIG. 2, illustrating a third joint configuration, the joint coupled between the first member and the body of the bag.

The joint 108 may have any suitable construction. For example and as illustrated in FIG. 8, the first member 104 includes a projection 150 having a substantially ball-shaped end 154. The ball-shaped end 154 is received by a socket 158 in a coupling member 162, which may be coupled to the body 12 of the bag 10. In other words, the ball-shaped end 154 and the socket 158 of the coupling member 162 define a ball-and-socket joint, which couples the first member 104 to the bag 12. The joint 108 of FIG. 8 is a ball-and-socket joint, and therefore, affords three degrees of freedom and therefore, allows the first member 104 to pivot about a first axis C that is parallel to the longitudinal axis A and a second axis D that is orthogonal or perpendicular to the longitudinal axis A. As such, the first member 104 is movable along a first 180 degree arc 166 or a second 180 degree arc 170 upon rotation of the first member 104. Additionally, the first member 104 is selectively lockable in a plurality of positions along either the first arc 166 or the second arc 170 by a locking member 174. For example, when in the second position, the first member 104 may be positioned and secured perpendicular to the longitudinal axis A such that the first member 104 projects on either of a first side of the bag 10 or a second, opposite side of the bag 10. Alternatively, the first member 104 may be positioned and secured at other angles relative to the longitudinal axis A along the arcs 166, 170 (illustrated in phantom in FIGS. 3 and 4, respectively). The locking member 174 may be rotatable member having cam surfaces that engage and disengage the ball-shaped end of the projection as illustrated in FIG. 8. Alternatively, the locking member 174 may include a push-button actuator 178 (FIG. 9) or a threaded member 182, 186 (FIGS. 10 and 11), although other locking members are contemplated. Elements 100, 104, 150, 158, and 162 are the same for the constructions of FIGS. 8-11 and are referenced accordingly (e.g. 100, 100', 100", 100'").

In alternative embodiments, the joint 108 may be a hinge joint (FIGS. 12-23). The first member 104 may include an aperture or through-hole 200 for receiving a fastener 204 therethrough. The fastener 204 extends through an aperture 208 in a coupling member 212 and an aperture (not shown) in the body 12 of the bag (10) for securing the first member to the body 12. The fastener 204 is oriented perpendicular to the longitudinal axis A of the bag 10. The first member 104 is therefore pivotable about the fastener 204 and perpendicularly with respect to the longitudinal axis A.

Figure 12:
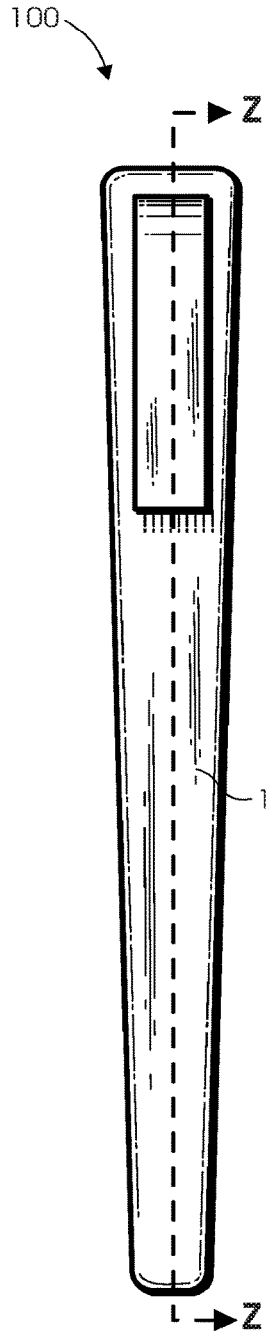
FIG. 12 is a front view of the joint of FIG. 2, illustrating a fifth joint configuration, the joint coupled between the first member and the body of the bag.
Figure 13:
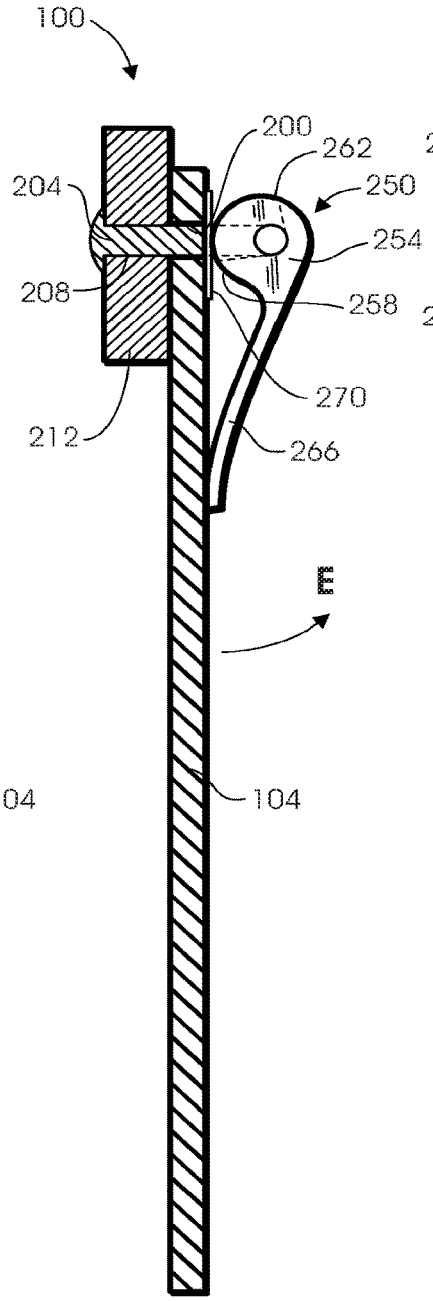
FIG. 13 is a cross-sectional view of the fifth joint configuration of FIG. 12 taken along line Z--Z, illustrating a cam clamp in a first position.
Figure 14:
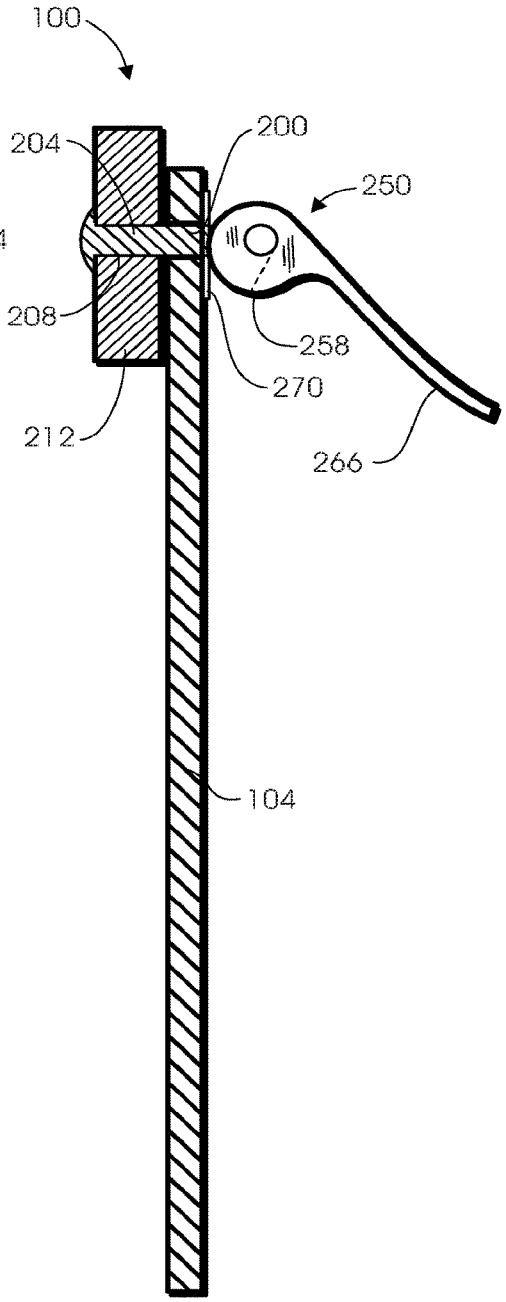
FIG. 14 is a cross-sectional view of the fifth joint configuration of FIG. 12 taken along line Z--Z, illustrating the cam clamp in a second position.

In the embodiment illustrated in FIGS. 12-14, a cam clamp 250 selectively locks or secures the first member 104 relative to the body 212. The cam clamp 250 includes a body 254 having a first cam surface 258 and a second cam surface 262 and an extension or leg 266 projecting from the body 254. The first cam surface 258 of the cam clamp 250 contacts a surface 270 of the first member 104 to secure the first member 104 relative to the body 12. A force in the direction of arrow E on the leg 266 pivots the cam clamp 250 to move the first cam surface 258 out of engagement with the first member 104 thereby allowing the first member 104 to pivot about the fastener 204 along a 180 degree arc as described above with respect to FIGS. 2-4. A force in the opposite direction of arrow E on the leg 262 pivots the cam surface 258 into engagement with the first member 104 thereby locking the first member 104 with respect to the body 12. The first member 104 may be locked at an angle along the arc.

Figure 15:
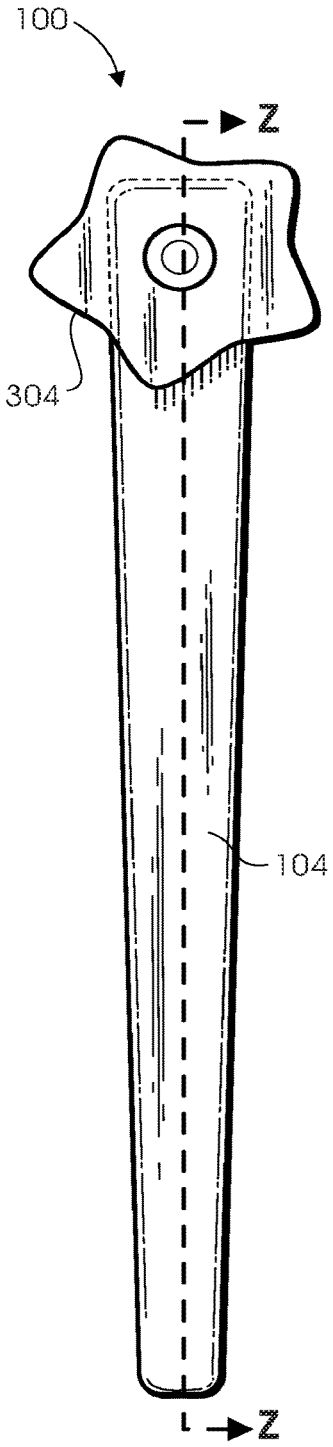
FIG. 15 is a front view of the accessory of FIG. 2, illustrating a sixth joint configuration, the joint coupled between the first member and the body of the bag.
Figure 16:
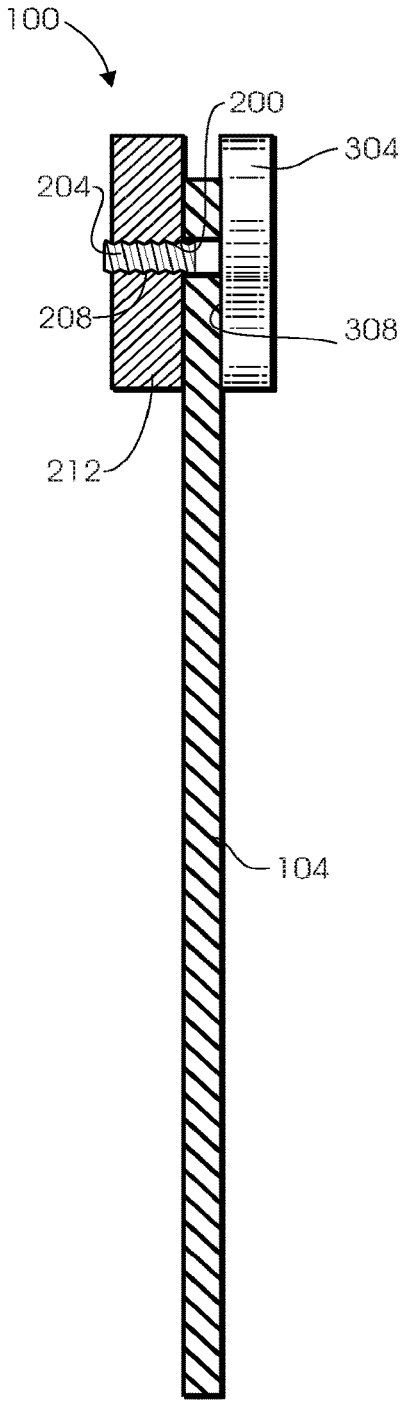
FIG. 16 is a cross-sectional view of the sixth joint configuration of FIG. 15 taken along line Z--Z, illustrating a friction clamp in a first position.
Figure 17:
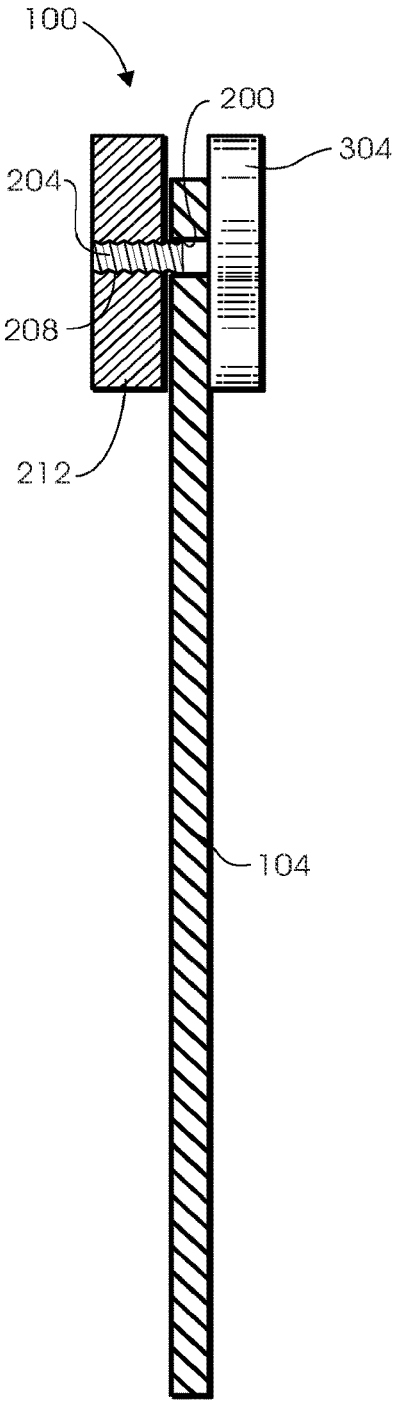
FIG. 17 is a cross-sectional view of the sixth joint configuration of FIG. 15 taken along line Z--Z, illustrating the friction clamp in a second position.
Figure 18:
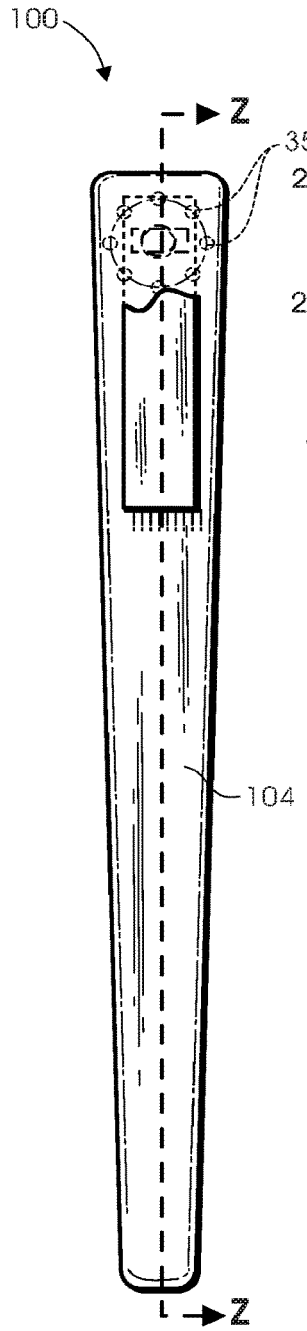
FIG. 18 is a front view of the accessory of FIG. 2, illustrating a seventh joint configuration, the joint coupled between the first member and the body of the bag.
Figure 19:
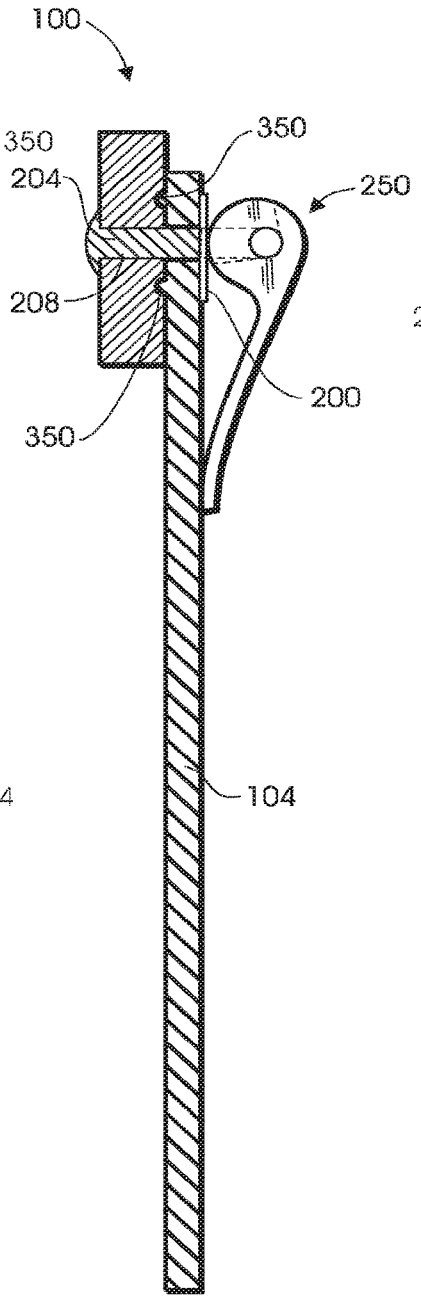
FIG. 19 is a cross-sectional view of the seventh joint configuration of FIG. 18 taken along line Z--Z, illustrating the cam clamp of FIGS. 12-14 in a first position.
Figure 20:
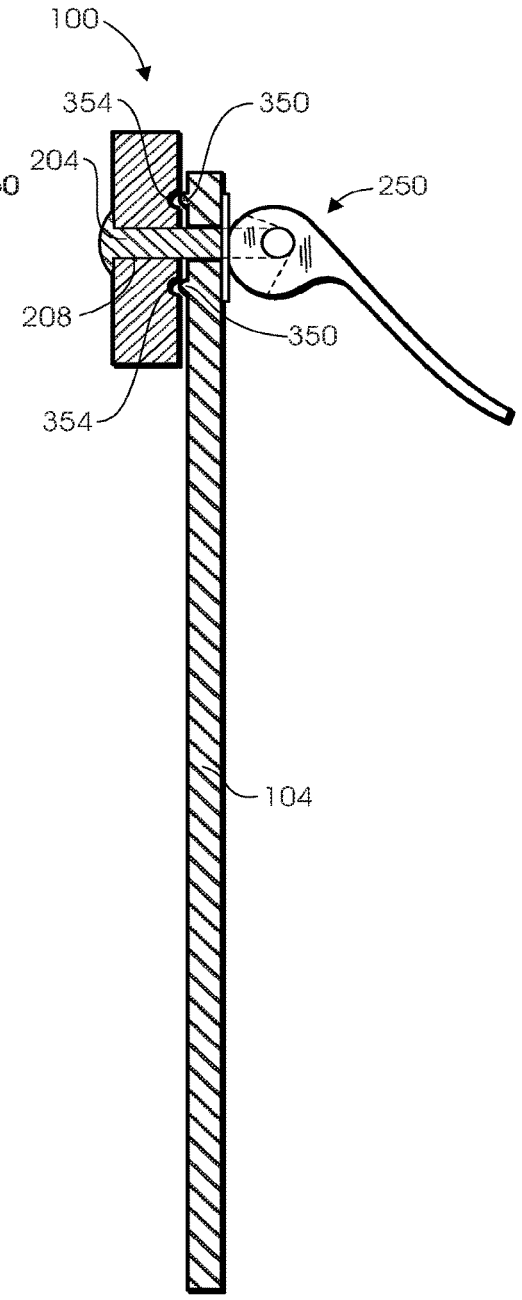
FIG. 20 is a cross-sectional view of the seventh joint configuration of FIG. 18 taken along line Z--Z, illustrating the cam clamp of FIGS. 12-14 in a second position.
Figure 21:
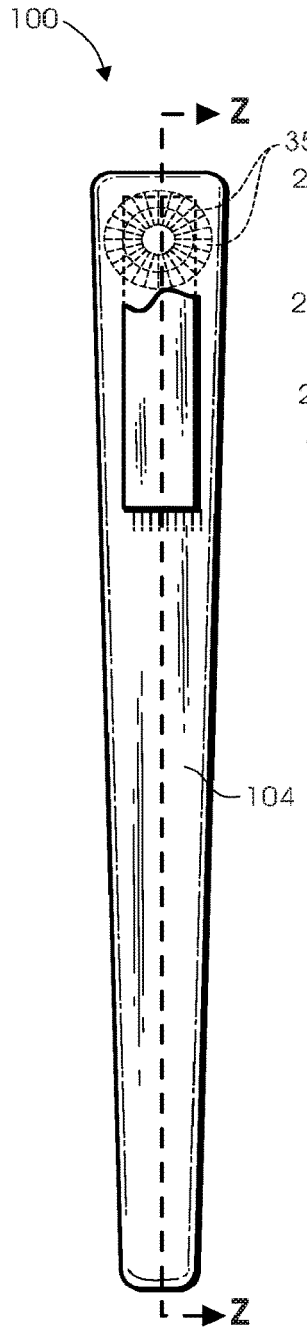
FIG. 21 is a front view of the accessory of FIG. 2, illustrating an eighth joint configuration, the joint coupled between the first member and the body of the bag.
Figure 22:
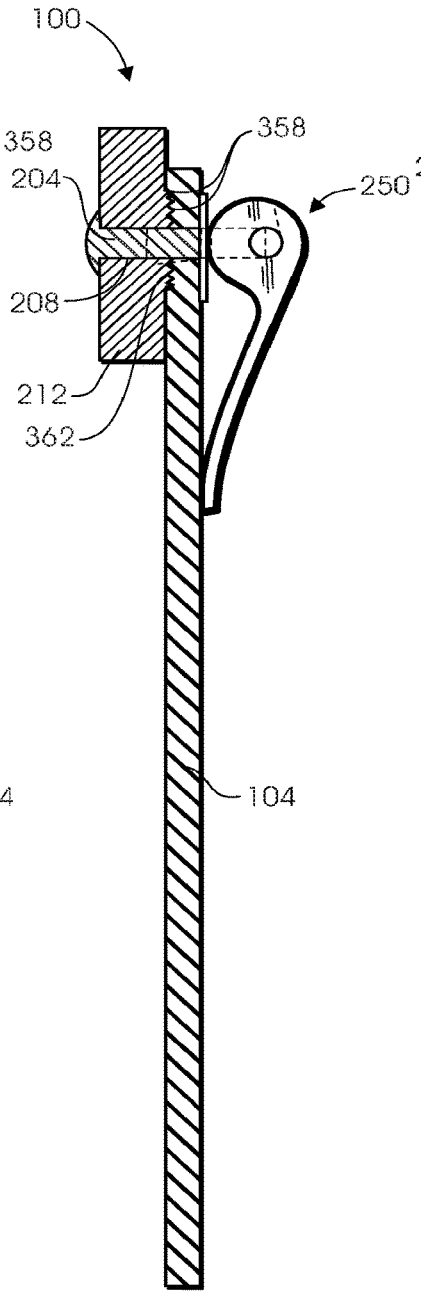
FIG. 22 is a cross-sectional view of the eighth joint configuration of FIG. 21 taken along line Z--Z, illustrating the cam clamp of FIGS. 12-14 in a first position.
Figure 23:
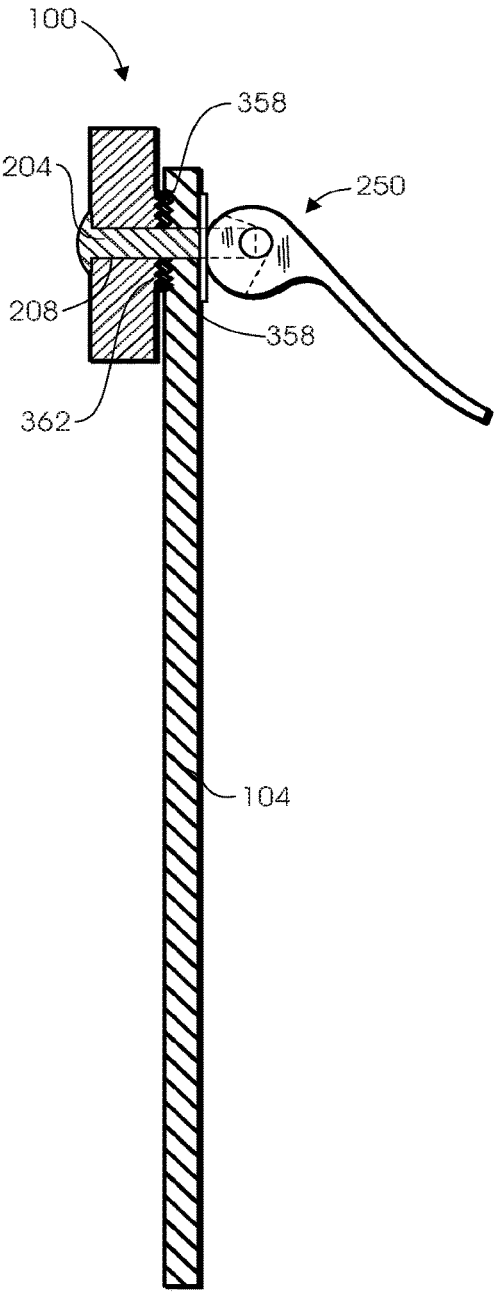
FIG. 23 is a cross-sectional view of the eighth joint configuration of FIG. 21 taken along line Z--Z, illustrating the cam clamp of FIGS. 12-14 in a second position.

In the embodiment illustrated in FIGS. 15-17, a friction clamp 300 selectively locks or secures the first member 104 relative to the body 12. The friction clamp 300 includes a dial or knob 304 coupled to the fastener 204, which is threaded. The first member 104 is secured relative to the body 12 by the knob 304, which is rotatable in a first direction to create a friction fit in which the first member 104 is secured between the body 12 and a surface 308 of the knob 304. The first member 104 may be locked at an angle along the arc. The knob 304 is rotatable in an opposite direction to move the surface 308 of the knob 304 out of engagement with the first member 104 thereby releasing the friction fit on the first member 104 thereby allowing the first member 104 to pivot about the fastener 204 along a 180 degree arc as described above with respect to FIGS. 2-4.

In the embodiments illustrated in FIGS. 12-14 and 15-17, the mating surfaces between the first member 104 and the coupling member 212 are smooth. However, the surfaces may have a plurality of locking positions as illustrated in the embodiments of FIGS. 18-20 and 21-23. For example, in the embodiment of FIGS. 18-20, the first member 104 may have a plurality of projections 350 radially spaced about the aperture 200 in the first member 104. The projections 350 are received by recesses 354 radially spaced about the aperture 208 in the coupling member 212. Therefore, when the cam clamp 250 is in the locked position (FIG. 19), the projections 350 are received within the recesses 354 and therefore, ensure that the first member 104 is locked with respect to the bag 10. When the cam clamp 250 is in the unlocked position (FIG. 20), the projections 350 can move among the recesses 354 to determine the orientation of the first member 104 relative to the longitudinal axis A. It should be understood that other types of actuators may be used in lieu of the cam clamp 250 to the lock the first member 104 in the embodiment FIGS. 18-20. Additionally, other types of resistance may be employed other than projections and recesses. For example, in the embodiment illustrated in FIGS. 21-23, the first member 104 and the coupling member 212 include mating grooves 358, 362, respectively, (i.e., ridges and valleys) rather than projections and recesses to increase the resistance therebetween. While not illustrated, a biasing mechanism (not shown) such as a spring or wave washer may be spaced between the first member 104 and the actuator 250, 300 for biasing the first member 104 into engagement with the coupling member 212.

Figure 24:
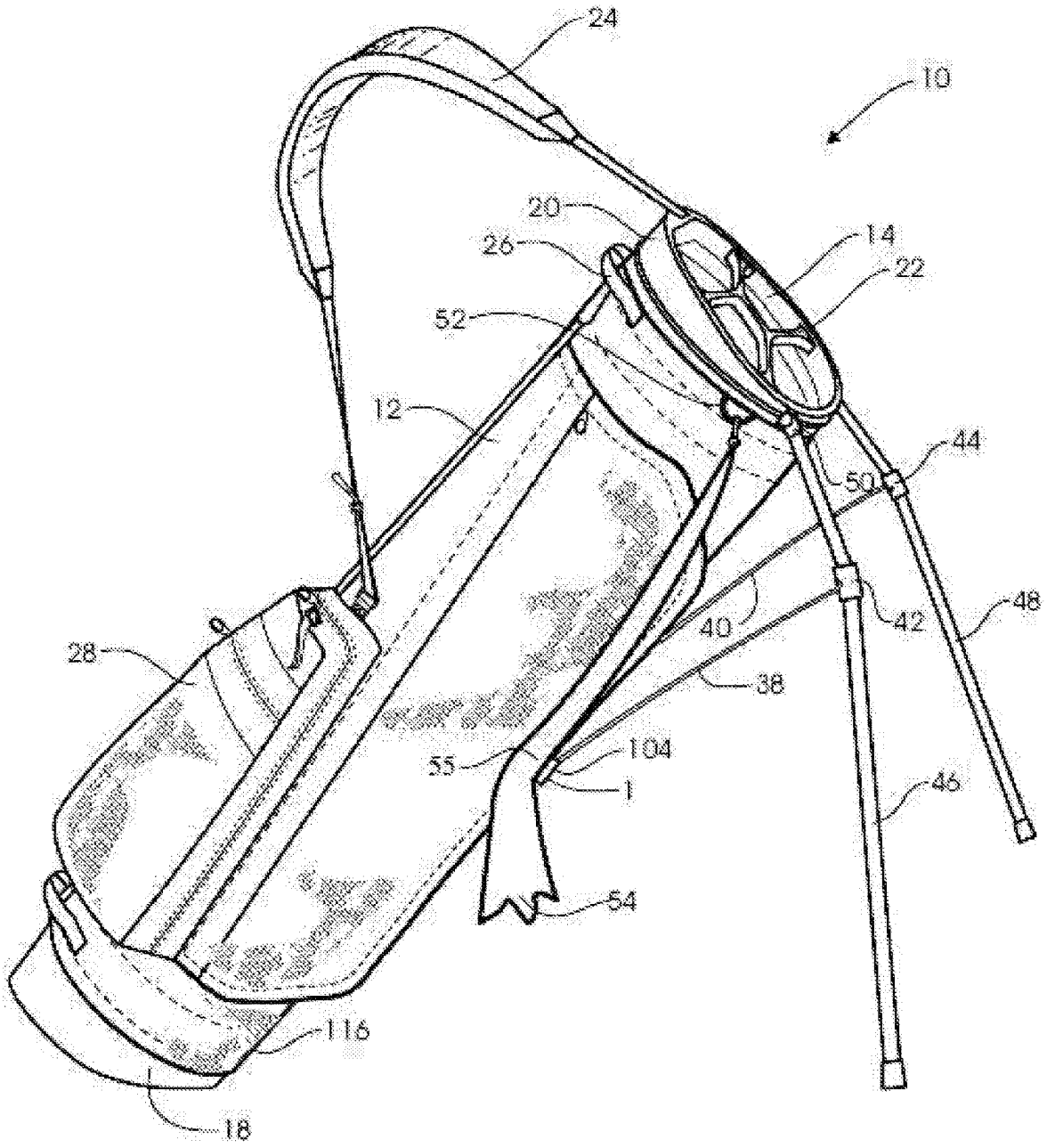
FIG. 24 is a perspective view of the golf bag of FIG. 1, the golf bag resting on the ground, and illustrating the accessory in the second position of FIGS. 3 and 4.
Figure 25:
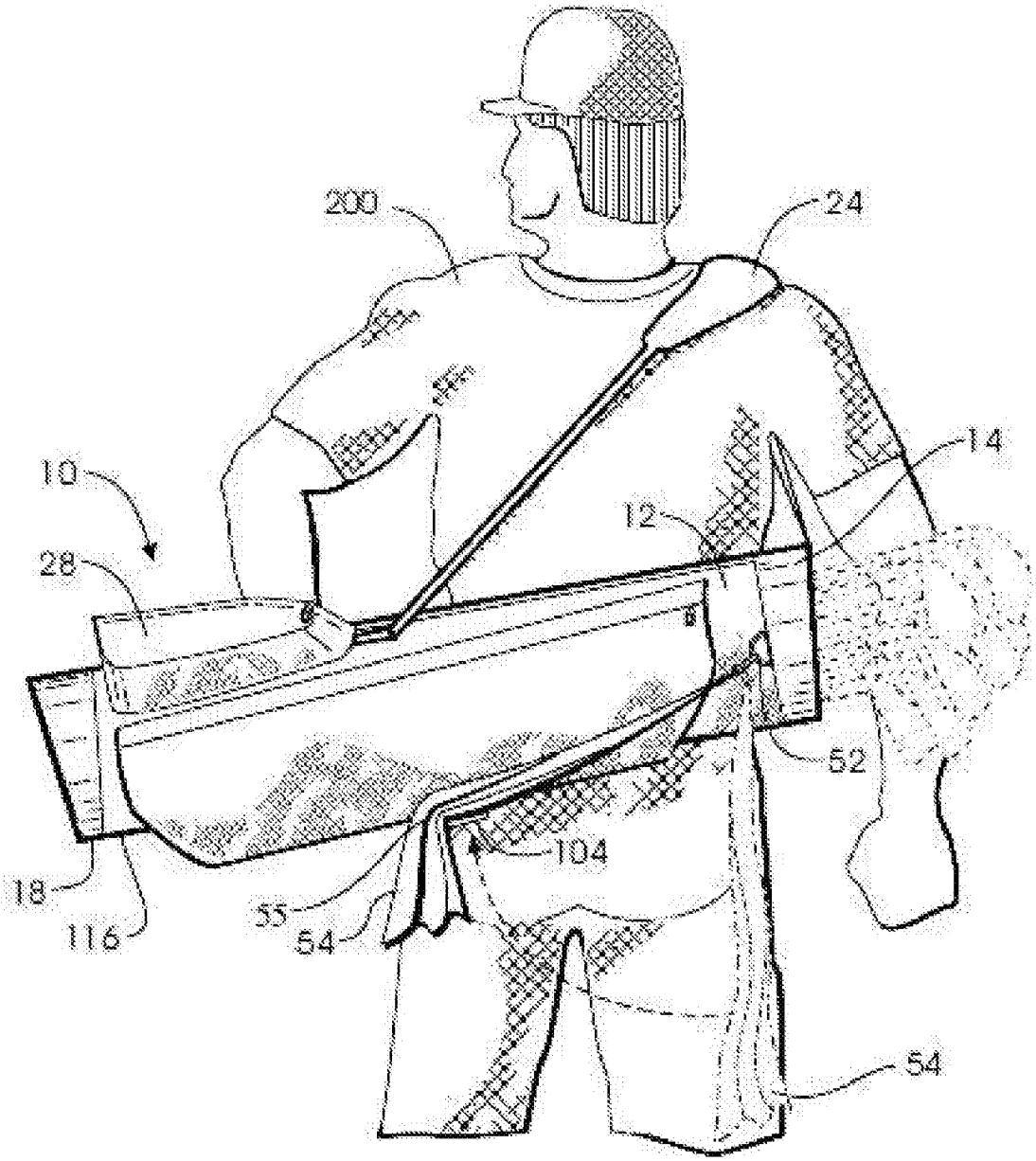
FIG. 25 is a perspective view of the golf bag of FIG. 1, the golf bag being carried by the golfer and illustrating the accessory in the second position of FIGS. 3 and 4.

In operation, an individual 200 unlocks the joint 108 (i.e., by means of the locking member 174). The individual 200 then pivots the first member 104 from the first position to the second position about the joint 108 to position the first member 104 relative to the body 12. As such, the first member 104, which was originally oriented parallel to the body 12 of the bag 10, may extend perpendicular with respect to the longitudinal axis A of the bag 10 when the second position. Once appropriately positioned, the individual 200 re-locks the joint 108 to secure the first member 104 relative to the body. As such, the towel 54 may rest on the first member 104 such that the towel 54 extends substantially parallel to the longitudinal axis A of the bag 10 between the attachment mechanism 52 and the first member 104. The towel 54 is thus spaced apart from the body 12. As illustrated in FIGS. 24-25, the first member 104 may be in the second position either while the bag 10 is resting against the ground (FIG. 24) or while the bag 10 is being transported by the individual 200 (FIG. 25). The first member 104 prevents the towel 54 from merely dangling and swinging against the individual's leg(s) and therefore prevents water from dripping on the individual's leg(s) while carrying the bag 10. The locking member 174 may be unlocked such that the first member 104 can move from the second position back to the first position in order to allow the legs 46, 48 to be deployed and retracted.

Additionally, while not illustrated herein, it should be understood that the first member 104 may be attached to a cart bag as well. The first member 104 prevents the towel 54 from merely dangling against the body 12 and therefore prevents the bag 10 from getting wet while resting on the ground or being transported by a cart.

Figure 26:
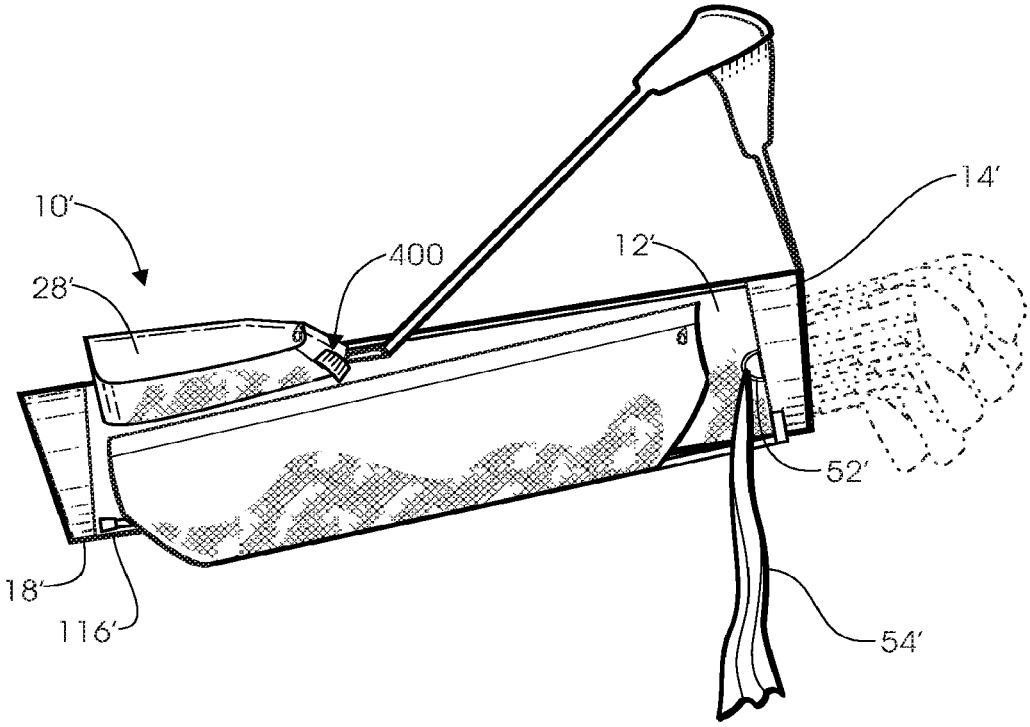
FIG. 26 is a perspective view of the golf bag of FIG. 1, the golf bag having an auxiliary attachment mechanism coupled to the body.
Figure 27:
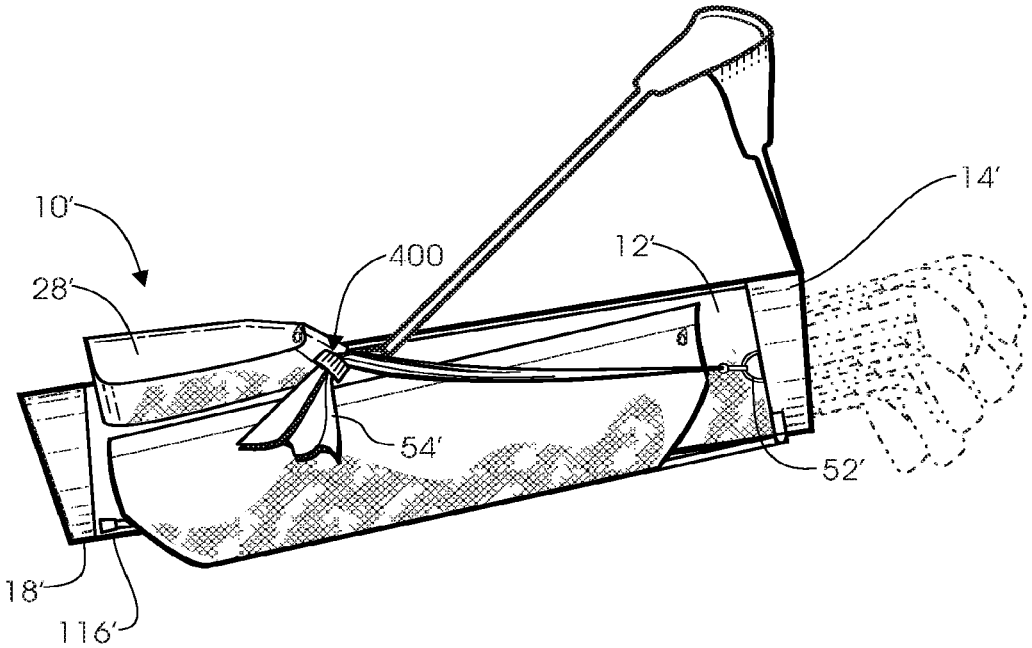
FIG. 27 is a perspective view of the golf bag of FIG. 26, wherein a golf towel is secured at a second point by the auxiliary attachment mechanism.

FIGS. 26 and 27 illustrate a golf bag 10' according to another embodiment of the invention. The golf bag 10' of FIGS. 26 and 27 are similar to the golf bag 10 of FIGS. 1-7 and 24-25. Therefore, like structure will be identified by like reference numbers with a prime (e.g., 10') and only the differences will be discussed hereafter.

The golf bag 10' includes an auxiliary attachment mechanism 400 that is coupled to the body 12' of the bag 10' (i.e., by fasteners or sewing). The auxiliary attachment mechanism 400 includes a body 404 that is a loop 408. In the illustrated embodiment, the loop 408 is an elastic band that is configured to receive a second end of the towel 54, the first end of which is secured to the attachment mechanism 52'. The elasticity of the band retains the towel 54' therein. As such, the auxiliary attachment mechanism 400 provides a second point of attachment that prevents the towel 54' from hanging down and getting caught between the user's legs. The towel 54' is also easily accessible when needed by the user. In other words, the user can easily thread the towel 54' through the loop 408 to stow the towel 54' and remove the towel 54' from the loop 408 to use the towel 54'.

In the illustrated embodiment, the auxiliary attachment mechanism 400 is spaced apart from the attachment mechanism 52' along the longitudinal axis A' of the bag 10' such that the towel 54' is stowed against the body 12' of the bag 10' when not in use. In the illustrated embodiment, the auxiliary attachment mechanism 400 is positioned adjacent the pocket 28' such that it is positioned at a distance D from the attachment mechanism 52. The auxiliary attachment mechanism 400 may be positioned at other locations along the body 12' of the bag 10' thereby shorting or lengthening the distance D between the attachment mechanisms 52', 400. Further, in the illustrated embodiment only one of each of the attachment mechanisms 52', 400 are located on one side of the bag 10'. In additional or alternative embodiments, there may be two of each of the attachment mechanisms 52', 400 such that the towel 54' may be secured on either side of the bag 10'. Additionally, while the auxiliary attachment mechanism 400 is illustrated herein as an elastic (e.g., elastically deformable) band, the auxiliary attachment mechanism may have other configurations. For example, the auxiliary attachment mechanism 400 may include a first portion and a second portion that are each attached to the bag 10' at a first end and configured to be secured to one another at a second, opposite end. In other words, each of the portions may include complimentary fasteners (i.e., hook-and-loop, snaps, etc.) such that the two portions are removably secured to one another about the towel 54'.

While the figures may depict particular body 12, and top and bottom portions 14 and 18, respectively, the apparatus, methods, and articles of manufacture described herein are not limited in this regard.

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

Various features and advantages of the apparatus, methods, and articles of manufacture described herein are set forth in the following claims.

What is claimed is:

1. A golf bag comprising:

a body defining a housing extending between a bottom portion and a top portion, a first side and a second side, the housing adapted to receive one or more golf clubs;

a pair of legs pivotally coupled to the top portion of the body;

an attachment mechanism to the body, the attachment mechanism configured to secure a first portion of a towel; and an accessory coupled to the bag separately from the attachment mechanism, the accessory comprising a first member having a first end and a second end;

a second member attached to the bag body such that it is stationary and oriented parallel to a body longitudinal axis; and a joint coupled between the first end of the first member and the body, wherein the joint comprises a coupling member and a locking member, the coupling member comprising a ball-type structure and a socket-type structure;

wherein the locking member comprises a plurality of cam surfaces that can engage the ball-type structure to prevent movement;

wherein the first end of the first member is secured within the joint, while the second end of the first member is movable along a single 180 degree arc by pivoting about the first end of the first member secured in the joint, and wherein the locking member can lock the second end of the first member in a plurality of positions along the 180 degree arc;

wherein the first member has a first position in which the first member extends parallel to the longitudinal axis of the bag such that the second end of the first member is closer to the bottom portion of the bag than the top portion;

wherein the first member has a second position in which the first member is substantially perpendicular to the longitudinal axis and approximately 90 degrees to the bag first side or second side from the first position;

wherein the second member secures the first member in parallel with the body of the bag when in the first position, and allows the first member to pivot relative to the bag to achieve the second position.

2. The golf bag of claim 1, wherein the first member is removable from the body.

3. The golf bag of claim 1, wherein the first member has a stowed position in which the first member extends parallel to the body longitudinal axis of the bag, and a support position in which the first member forms an angle relative to the body longitudinal axis.

4. The golf bag of claim 3, wherein the first member is received by the second member when in the stowed position.

* * * * *